United States Patent [19]

Baguéna

[11] Patent Number: 4,572,118

[45] Date of Patent: Feb. 25, 1986

[54] VARIABLE VALVE TIMING FOR FOUR-STROKE ENGINES

[76] Inventor: Michel Baguéna, 62, Av. Aristide Briand, Paron-Sens (89100), France

[21] Appl. No.: 537,378

[22] PCT Filed: Dec. 29, 1982

[86] PCT No.: PCT/FR82/00221

§ 371 Date: Aug. 30, 1983

§ 102(e) Date: Aug. 30, 1983

[87] PCT Pub. No.: WO83/02301

PCT Pub. Date: Jul. 7, 1983

[30] Foreign Application Priority Data

Dec. 31, 1981 [FR] France ..... 81 24559

[51] Int. Cl.[4] ..... F01L 1/34

[52] U.S. Cl. ..... 123/90.16; 123/90.27

[58] Field of Search ..... 123/90.44, 90.27, 90.16, 123/90.17, 90.15

[56] References Cited

U.S. PATENT DOCUMENTS 1,444,857 2/1923 Taub ..... 123/90.27

FOREIGN PATENT DOCUMENTS 2256185 11/1972 Fed. Rep. of Germany .
2629554 1/1978 Fed. Rep. of Germany .
3022188 12/1981 Fed. Rep. of Germany ... 123/90.44
178006 9/1935 France .
1285170 1/1962 France ..... 251/251

*Primary Examiner*—William R. Cline
*Assistant Examiner*—Peggy A. Neils
*Attorney, Agent, or Firm*—A. W. Breiner

[57] ABSTRACT

A device for internal combustion engines particularly automobile engines, which varies the opening duration and the lift of the timing valves. This variation results from the utilization of all or part of the profile of an alternating cam of which the motion about an axis is provided by rotating main cams which contact rollers carried on the alternating cam, and is transmitted to a roller in contact with the lever which then actuates the valve. The timing is varied by adjusting the position of the roller by means of support arms by which the roller is displaced with respect to the alternating cam and lever.

8 Claims, 21 Drawing Figures

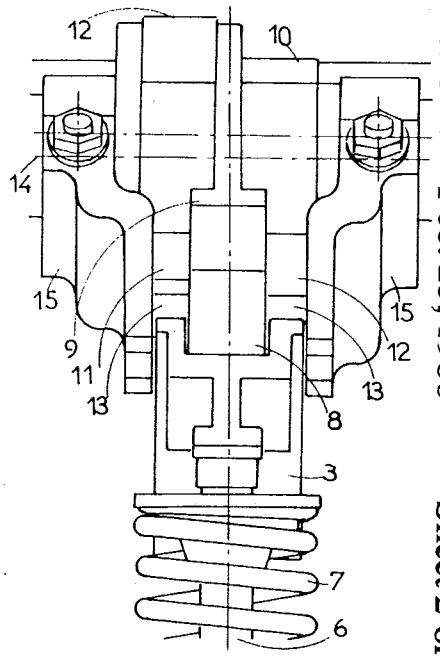
FIG 6
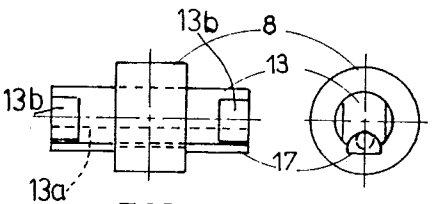
FIG 8
FIG 7
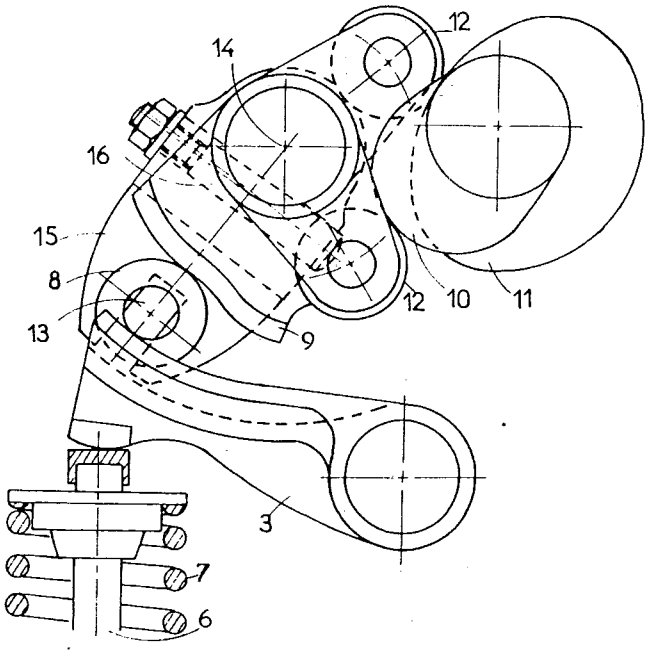
FIG 5
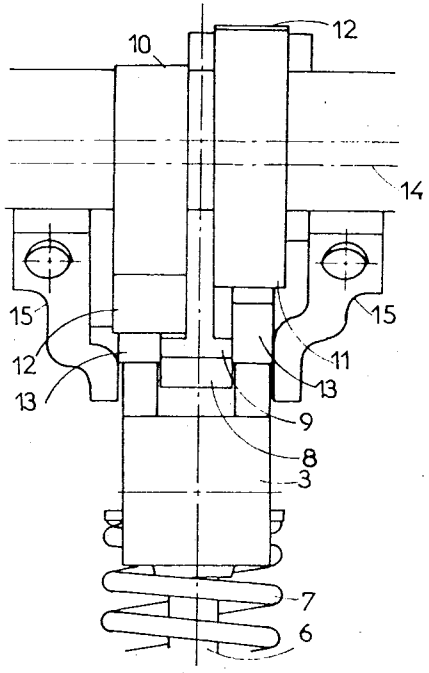
FIG 4

6
7
9
10
11
12
14
32
33
34
35
36

VARIABLE VALVE TIMING FOR FOUR-STROKE ENGINES

The present invention concerns a mechanism for internal combustion engines that makes it possible to vary the opening and lift time of intake and exhaust valves. Mechanical valve gears equipped with such adjustments have already been patented, although none has actually been put into application due to certain major limitations.

In most of these mechanisms, movement is produced by a pitman rod system. The resulting disadvantages are illustrated by the schematic representation of FIG. 1, which is a variant of the prior art. Variable opening of the valve (6), for which the spring (7) causes the return movement, is obtained by using all or part of a static cam profile (5) that is positioned for just this purpose. The roller (4), activated by the short connecting rod (1) of the crankshaft (2), which is subjected to back-and-fourth movement along the profile of the static cam (5), communicates this motion to the lever (3), thus actuating the valve (6). While the distance of reciprocal movement remains constant, the length of the active portion of the profile of the static cam (5) varies in inverse proportion to that of the neutral portion. The laws of valve (6) opening and closing are approximately symmetrical.

Here, the static cam (5) is set in the position corresponding to the longest valve (6) opening and lift time. The solid line in the drawing shows the short connecting rod (1), lever (3), roller (4), valve (6), and spring (7) in the position of maximum valve (6) lift; the broken line indicates the positions at beginning of opening and end of closing of the valve (6).

The valve (6) stroke is greater than 150° which, for a fourstroke engine in which the shaft (2) is turning at half-speed, represents a cam angle greater than 300 CD (CD=camshaft degrees, at engine output).

Valve (6) opening times of such long duration, only used in sports car engines, could bring about the following adjustments, given as an illustration:

advance intake opening=45 CD delay intake closing=75 CD

Note that even for a long maximum valve (6) opening time, less than half the crankshaft (2) travel range is active.

Considering also the limitations created by the profile of the static cam (5), both camshaft (2) travel range and the corresponding distance of alternating movement are too great. The resulting bulkiness explains why the system is incompatible with modern, compact engines.

A German prior art patent concerns a mechanism with an alternating cam moved by a rotating cam; adjustment consists of placing the main camshaft out of center in such a way as to cause relative rotation of the alternating cam with respect to the lever that actuates the valve. Adjustment by the main out-of-center camshaft precludes the use of a single camshaft for both intake and exhaust, and the resulting mechanism is far too bulky.

The present invention makes it possible to avoid these drawbacks by using a valve actuation device built according to the principle of a kinematic chain with two cams; the main cam, in fixed-axis rotation, communicates the invariable primary reciprocating movement to a reciprocating/pivoting arm, based on which the appropriate system makes it possible to use all or part of the profile of the secondary valve lift cam, which can be static, reciprocating, or rocking, depending on the manner in which the invention is realized. The invariable back-and-forth laws in reciprocating movement can be perfectly symmetrical or very distinct; the result is that the valve opening and lift phase are symmetrical or asymmetrical, respectively. For very brief valve opening times, it is preferable to limit valve lift distance in order to avoid considerable efforts on the parts. With sufficient valve opening time, however, it is possible to maintain a long valve stroke or modify it very gradually, increasing the travel range.

The present invention offers the widest possible choice for the law of primary alternating movement; the entire minimized travel range is used by the second valve lift cam during the greatest valve opening time. This advantage is possible due to the neutral portion of the reciprocating movement, corresponding to the neutral portion of the main cam in rotation. The overall dimensions of the unit are thus greatly reduced.

Note too that the freedom left for the law of reciprocating motion makes it considerably easier to plot the secondary valve lift cam. Lastly, when the axis of rotation of the main camshaft is maintained fixed, it can actuate the intake and exhaust valves and thus preserve the small overall dimensions of conventional single overhead camshaft engines.

The main cam in rotation, responsible for primary reciprocating motion, creates unilateral or bilateral linkage. In the case of unilateral linkage, the return reciprocating movement is achieved by means of the elastic return force or by using one or several springs. In certain variants, these springs also cause the return movement of the valve. When adapted to the various invention realization modes, the springs can be used for compression, traction, deflection or torsion.

In the most general type of set-up, a main cam is used for outward movement. In the case of bilateral linkage, a return cam is generally responsible for the return movement.

The use of grooved cams should be avoided due to machining difficulties. Contact with the aforementioned cams can be made using shoes having an appropriate shape (12 BIS), a frame (37) or rollers (12) which provide non-slip contact with the cams.

In accordance with engine design, the invention can use either tappets (38), levers (3), rockers (19, 32), or rocker arms (20) to absorb the reactions of the cams actuating the valves, as well as pushrods (18) as shown in FIGS. 2 and 3, when moving the camshaft away from the valves. A partial list of advantages and invention realization modes is given below, for purposes of illustration.

BRIEF DESCRIPTION OF THE DRAWINGS

FIG. 5 represents the main cross view of the first invention realization mode.

FIGS. 4 and 6 correspond, respectively, to right- and left-hand views of the first invention realization mode.

FIGS. 7 and 8 show the adjustment roller and its axis of rotation, equipped with an anti-wear shoe.

In FIG. 2, the valve law variation mechanism is connected between the pushrod and the valve, the mechanism being close to the valve. On the contrary, in FIG. 3 the pushrod is connected between the valve law variation mechanism and the valve, the mechanism being far from the valve.

Figure 1:
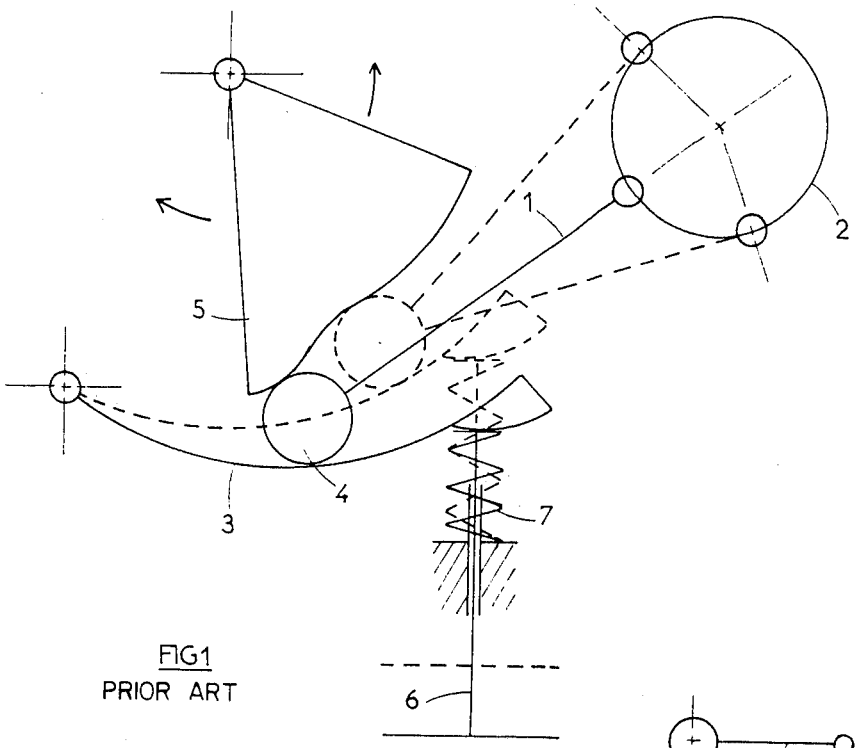
FIG1 PRIOR ART
FIG. 1 shows a prior art valve actuating mechanism.
Figure 2:
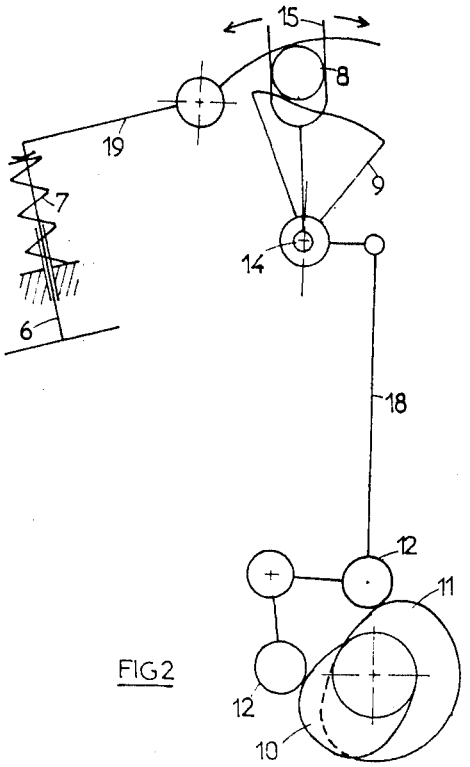
FIGS. 2 and 3 are schematic representations of two variants on the first invention realization mode in which the camshaft is moved away from the valve by means of a pushrod (18).
Figure 3:
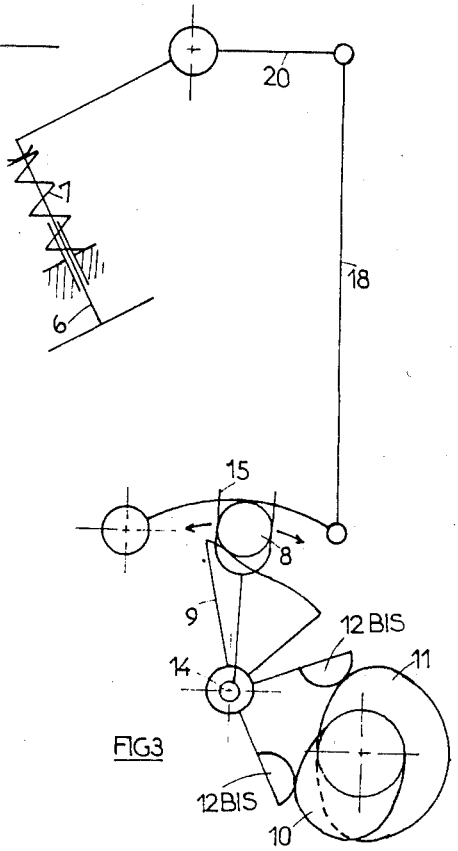

In overview, the invention, as seen from the drawing, particularly prior art FIG. 1, schematic FIGS. 2 and 3 and FIGS. 4–8, describes a valve control mechanism comprising a kinematic chain including a main driving cam 10 rotating around a fixed axis and transmitting, through the contact with rollers 12 carried on a second cam 9, or with shoes 12 BIS, as in FIG. 3, an invariable alternating primary movement to cam 9 which is thus a rocking cam oscillating around a second axis (axis of control shaft 14). This oscillating cam 9 produces a valve lift secondary movement, which is not directly transmitted to the valve 6 or to the valve lifting lever 3, but to roller means comprising a roller 8 in contact with and rolling on a profile of the oscillating cam 9, and a roller axis 13 in contact with and sliding on a portion of the cam lifting lever 3. There is further control means allowing the use of a more or less important portion of the profile of the oscillating cam 9 in causing the displacement of roller 8 with respect to the oscillating cam profile by adjustably fastening support arms 15 above the axis of the control shaft 14, due to the fact that the roller axis 13 is received by its two ends in guiding grooves formed in these support arms 15. It is noted that there is no operative relationship between the rollers 12 and the support arms 15 of the control means. The rollers 12 are mounted on cam 9 (and more precisely rotatively mounted around fixed axes on cam 9) so as to transmit preferably with amplification an invariable alternative movement from the driving cam 10 and the return cam 11 to the oscillating cam 9. The main cam means, comprising the driving cam 10 and the return cam 11, performs the single function of transmitting an invariable alternative primary movement to the oscillating cam 9, rocking around the axis of control shaft 14. The movement of the main cam means is not transmitted to the valve 6. The latter is lifted by the action of lever 3. Lever 3 actuates the valve 6 under the indirect influence of the oscillating cam 9, because lever 3 is displaced by the roller axis 13 subjected to a radial movement with respect to the axis of control shaft 14, due to the contact of roller 8 against the profile of the oscillating cam 9. Therefore, the rollers 12 carried on the oscillating cam 9 have no operative relationship with control shaft 14 having an axis around which the oscillating cam 9 is rocked. It is by turning the shaft 14 on which the arms 15 are fixed or by turning the arms 15 around the shaft 14 that the roller 8 is adjustably displaced with respect to the cam 9 and to the lever 3. Further the variation of the valve opening duration, and therefore the variations of the opening and/or closing times, results from the use of a more or less important portion of the oscillating cam profile. The amplitude of the alternative primary movement is completely used by the oscillating cam 9 for lifting the valve 6 during the longest opening duration (see page 3, second paragraph, of the specification). The adjustment is obtained in changing the position of the roller 8 by a rotation around the second rotation axis (axis of shaft 14). To each position of the roller 8 corresponds a movement law for the valve 6. The various embodiments or realization modes of the invention will be described in detail in reference to the drawing.

In the first invention realization mode, represented in FIGS. 4, 5, and 6, the cam (9) of the valve (6) lift mechanism oscillates around an axis (14); the alternating movement is produced by the rotational driving movement of the main cam (10) and the return cam (11). The roller (8) receives the lift motion from the cam (9) and communicates it, by means of its axis (13), to the lever (3) which actuates the valve (6). The neutral portion of the reciprocal cam (9) as well as the upper part of the lever (3) in contact with the axis (13) of the roller (8) are arcs of circles whose centers coincide with the axis (14) while the valve (6) is closing. The U-shaped profile of the lever (3) maintains the roller (8) lateral. To adjust, change the position of the roller (8) by rotating around the axis (14). Each roller (8) position corresponds to a valve (6) movement law.

In the present realization, the support arms (15) of the axis (13) of the roller (8) are fastened to the control shaft (14) using a crank cotter pin (16). The valve (6) is shown in a constantly closed position, although during the rising movement of the roller (8), the ends of the axis (13) trace the guide grooves 13*a* machined into the arms (15), which are usually radial with respect to the axis (14). The two parallel flat surfaces 13*b* at either end of the axis (13) in contact with the grooves mentioned above, render these stresses negligible and at the same time maintain the axis (13) lateral. In order to reduce the stresses due to contact with the axis (13) and the upper part of the lever (3), it is possible to increase somewhat the radius of curvature under the axis (13) at the level of contact mentioned above, using conventional means.

Efforts to achieve greatest reliability using endurance tests showed the entirely satisfactory behavior of the variant in which the axis (13) is equipped with an anti-wear shoe (17), shown in FIGS. 7 and 8. Parts (13) and (3), in contact each with a surface of the shoe (17), have the same radius of curvature as the shoe (17) itself, which consists of two bearing surfaces in the form of arcs around which two rotations take place simultaneously while the valve (6) is rising—one in the groove of the axis (13) and the other on the upper part of the lever (3). At its center, the shoe (17) also includes clearance for the roller (8) to pass. According to this arrangement, the roller (8) maintains the shoe (17) in a lateral position.

Figure 18:
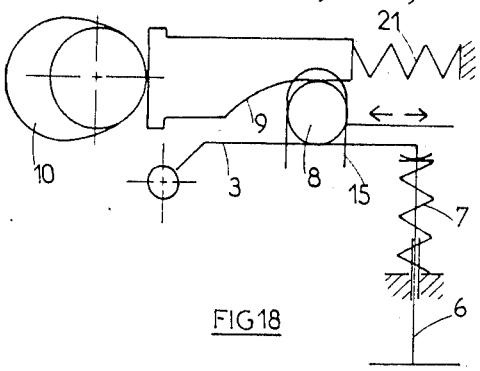
FIGS. 18, 19, 20, and 21 are schematic representations of variants on the first, second, third, and fourth invention realization modes, respectively.

Moreover, according to a variant of the first invention realization mode, shown in FIG. 18, the reciprocating movement of the cam (9) is straight, with the main cam (10) providing the outward movement and the coil spring (21) providing the return movement. The unusable portion of the reciprocating cam (9) and the upper part of the lever (3) are thus parallel while the valve (6) is closing. The adjustment roller (8) is aligned in the same direction by moving the slide (15).

Figure 11:
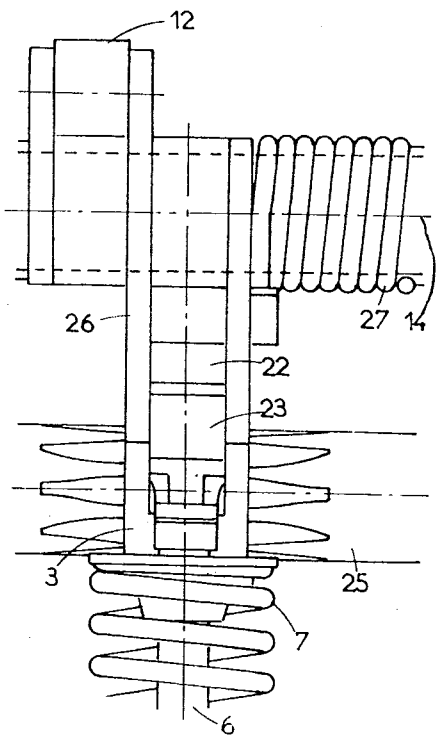
FIGS. 9 and 11 correspond, respectively, to the right- and left-hand views of the second invention realization mode.
Figure 10:
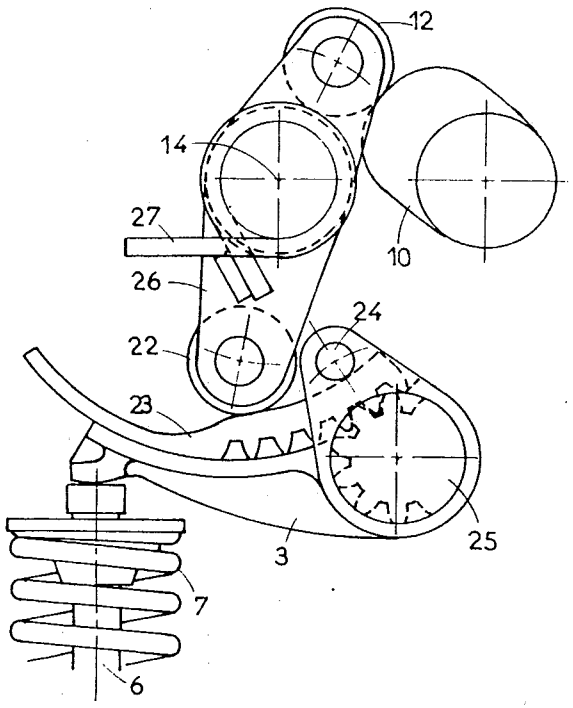
FIG. 10 represents the main cross view of a second invention realization mode.
Figure 9:
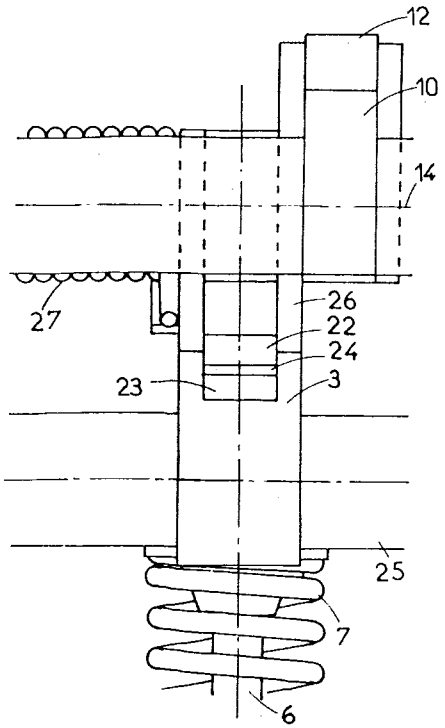

FIGS. 9, 10, and 11 show the second invention realization mode, in which the valve (6) lift cam (23) and support lever (3) rotate around the axis (25) while actuating the valve (6).

The main cam (10) moves the rocking cam (23) by means of the reciprocating/pivoting arm (26). The torsion spring (27) provides the return movement around the axis (14) of the reciprocating/pivoting arm (26), which is subjected to primary reciprocating motion. Contact at either end of the reciprocating/pivoting arm (26) is made by rollers, one (12) near the main cam (10) and the other (22) near the rocking cam (23). The upper part of the support lever (3) is an arc concentric with the unusable portion of the rocking cam (23) and whose center coincides with the axis of oscillation (14) of the reciprocating/pivoting arm (26) when the valve (6) is closing.

Adjustment is made by moving the rocking cam (23) on the top of the support lever (3), that is, turning the drive shaft (25) which moves the cam by means of the gear toothing. This type of linkage does not introduce any relative movement from the rocking cam (23) to the support lever (3) during valve (6) rise. On the oscillation axis (25) side of the support lever (3) there is a fork joint of constant lateral thickness that guides the rocking cam (23). Both the back and top of the rocking cam (23) are in the shape of concentric circles. Thus, the transverse axis (24) situated at the end of the fork joint maintains the rocking cam (23) on the support lever (3).

Figure 19:
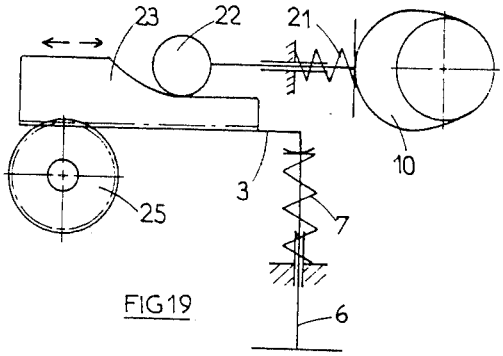

According to the variant of the second invention realization mode, shown in FIG. 19, the top, the unusable portion, and the back of the rocking cam (23) in contact with the upper part of the support lever (3) are straight. The roller (22) moves the rocking cam (23) in the same straight line as the unusable portion of the rocking cam (23) while the valve (6) is closing. The maincam (10) provides the outward reciprocating movement of the roller (22) and the coil spring (21) provides the return movement.

Figure 14:
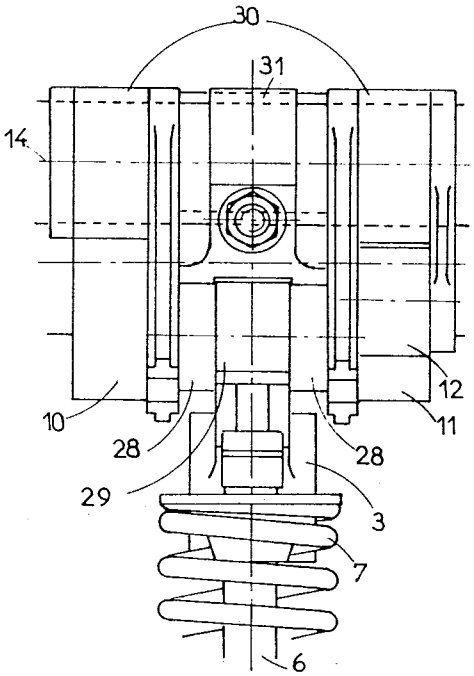
FIGS. 12 and 14 correspond, respectively, to right- and left-hand views of the third invention realization mode.
Figure 13:
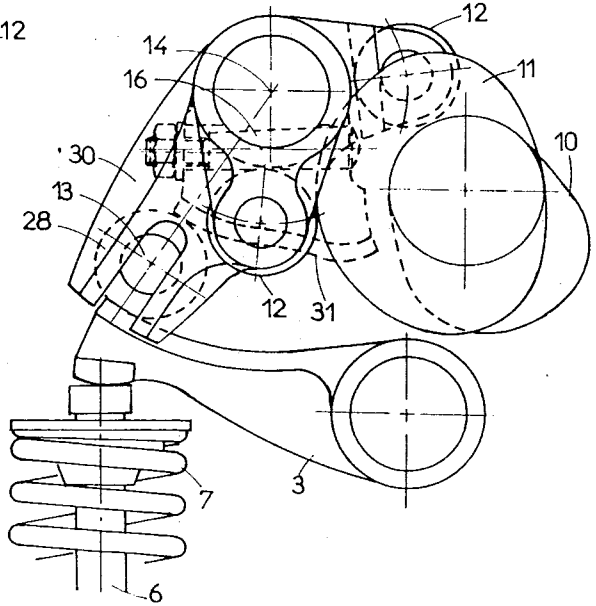
FIG. 13 represents the main cross view of a third invention realization mode.
Figure 12:
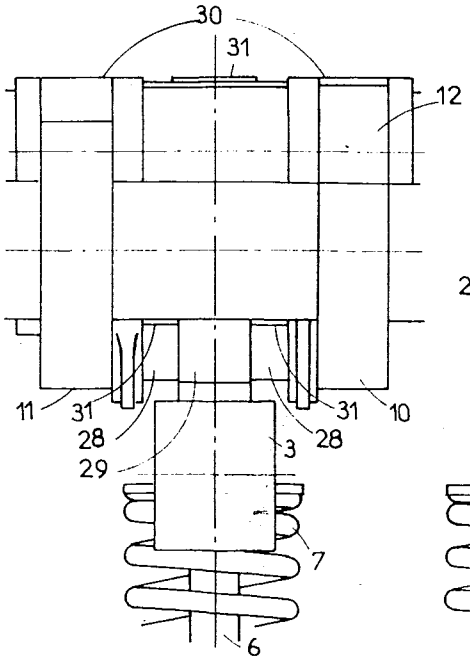

In the third invention realization mode, shown in FIGS. 12, 13, and 14, the roller (28, 29) rubs against both the static cam (31) that produces the secondary valve (6) rise movement, and the upper part of the lever (3). The main cam (10) and return cam (11) communicate movement to the reciprocating/pivoting arm (30) which, oscillating around the axis (14), moves the roller (28, 29). During the rising movement of the roller (28, 29) the ends of its axis (13) move along the guide grooves machined into the reciprocating/pivoting arm (30), which is usually radial with respect to the axis (14). At either end of the axis (13) is a flat surface that limits the contact stress on the aforementioned grooves and maintains the axis (13) lateral. The unusable portion of the static cam (31) and the top of the lever (3) are arcs whose centers coincide with the axis of oscillation (14) while the valve (6) is closing. A crank cotter pin (16) fastens the static cam (31) to the oscillating shaft (14).

Adjustment is made by altering the position of the static cam (31); this is accomplished by turning the drive shaft (14). Each position of the static cam (31) corresponds to a length of valve (6) stroke. The surfaces cannot be maintained in good condition using a one-piece roller (28, 29) due to the slipping that results from the simultaneous forces of compression exerted by the static cam (31) and the lever (3). To correct this drawback, the roller (28, 29) consists of three bearing elements; the middle roller (29) rubs only against the lever (3) and the two identical end rollers (28) rub only against the static cam (31). The middle roller (29) has a diameter greater than that of the end rollers (28) in order to avoid any contact between the end rollers (28) and the lever (3). Thus, no particular precautions are needed when positioning the lever (3) laterally, which is otherwise a delicate operation. The static cam (31) is designed with clearance in the middle to allow the roller (29) to pass.

Figure 20:
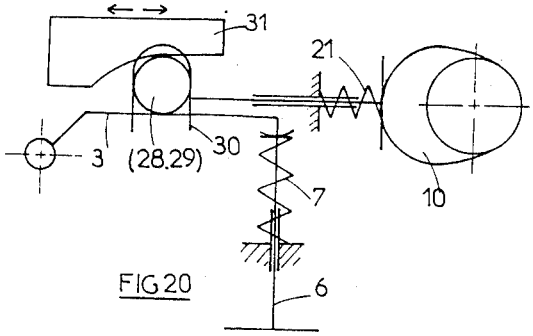

In the variant shown in FIG. 20 of the third invention realization mode, the guide (30), which is moved by the main cam (10) and the return spring (21) communicates reciprocating movement to the roller (28, 29). The unusable portion of the static cam (31) and the upper part of the lever (3) are parallel while the valve (6) is closing. Adjustment is made by moving the static cam (31) in a straight line. Note that switching the functions of the static cam (31) and the reciprocating roller (28, 29) in the third invention realization mode results, very symmetrically, in the first invention realization mode, using a reciprocal cam (9).

Figures 15, 16, 17:
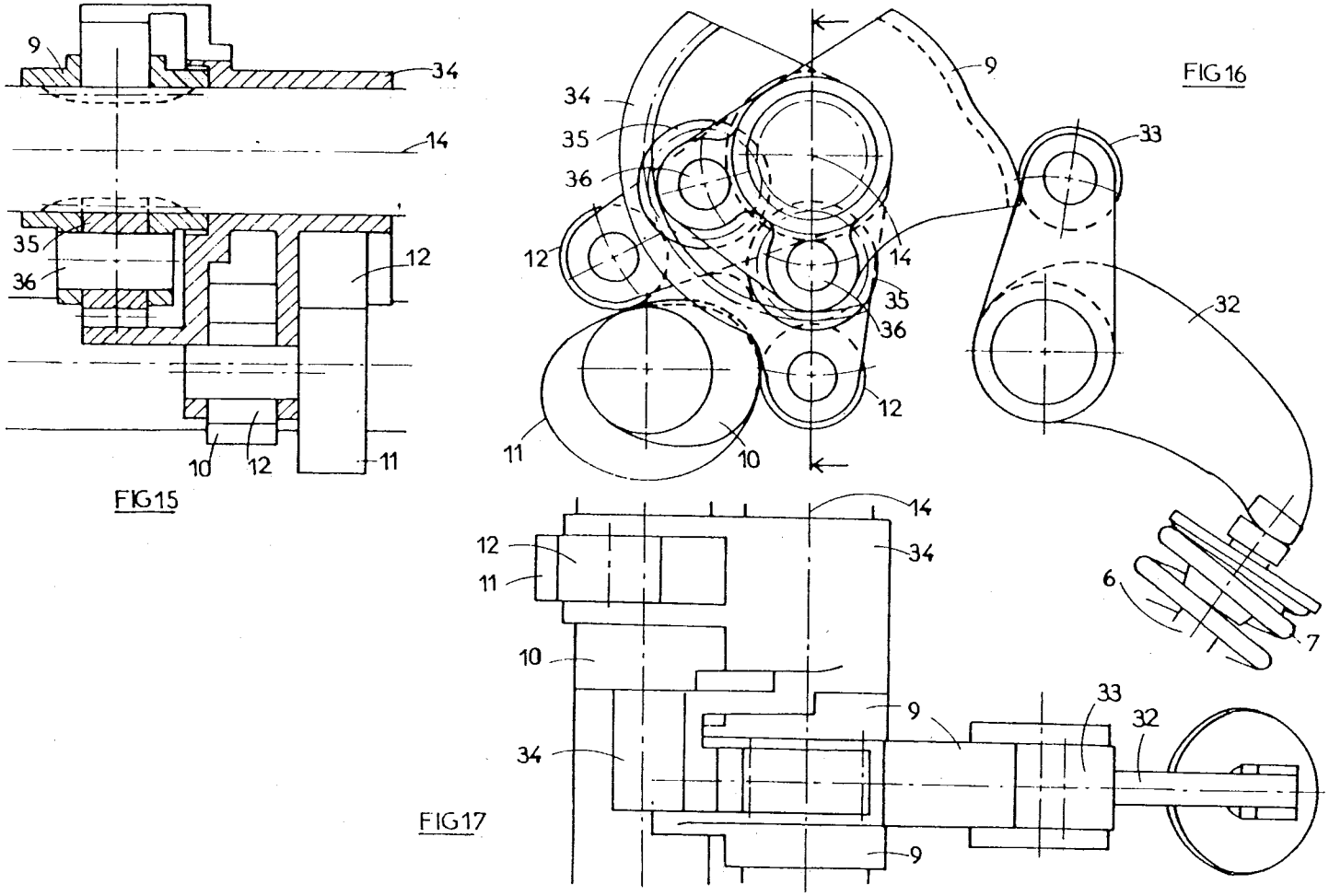
FIG. 16 represents the main cross view of a fourth invention realization mode.
FIG. 15 corresponds to the right-hand view of the fourth invention realization mode, represented by the plan section in which the arrows show the outline and indicate the direction of observation.
FIG. 17 corresponds to the view of the fourth invention realization mode as seen from above.

FIGS. 15, 16, and 17 show the fourth invention realization mode, in which the variation consists of shifting the reciprocating motion of the cam (9) using a planetary gear train. The reciprocating cam (9) moves the roller (33) of the reciprocating/pivoting arm (32) which actuates the valve (6). The functions of the reciprocating cam (9) and the contact roller (33) can obviously be switched. In this case, the cam, which becomes a rocker, machined in the rear part of the reciprocating-/pivoting arm (32), is moved by a roller that receives the same oscillating motion around the axis (14) as does the cam (9).

In the planetary gear train assembly shown here, actuation is initiated by the sun wheel cut into the shaft (14) around which the satellite vehicle (9) and the outer sector gear (34) oscillate. The outer sector gear (34) receives the primary reciprocal movement from the main cam (10) and the return cam (11) by means of contact with two rollers (12), and it communicates this movement to the intermediate satellites (35) that are in fact the same part as the reciprocating cam (9), which acts as satellite vehicle (35). During alternating rotation around their axes, the satellites (35) mesh with the drive shaft (14) which remains motionless, and around which the oscillating movement is communicated to the satellite vehicle cam (9).

One rotation of the drive shaft (14) corresponds to one extra rotation of the satellites (35), which shifts the satellite vehicle (9) with respect to the oscillating sector gear (34) and the roller in contact (33). Thus, each position of the drive shaft (14) corresponds to a different valve (6) lift.

The properties of planetary gear trains make it possible to use, with equal ease, the outer sector gear (34), the satellite vehicle (9), or the sun wheel of the shaft (14) as input or output control, according to the six possibilities listed in the table below, and for which the meanings of the abbreviations are as follows:

| Primary alternating oscillating INPUT movement | Alternating oscillating OUTPUT movement communicated to the cam | CONTROL |
|---|---|---|
| OS | SV | SW |
| OS | SW | SV |
| SV | OS | SW |
| SV | SW | OS |
| SW | OS | SV |
| SW | SV | OS |

OS = outer sector gear
SV = satellite vehicle
SW = sun wheel

The first line of the table corresponds to the realization shown in FIGS. 15, 16, and 17.

Figure 21:
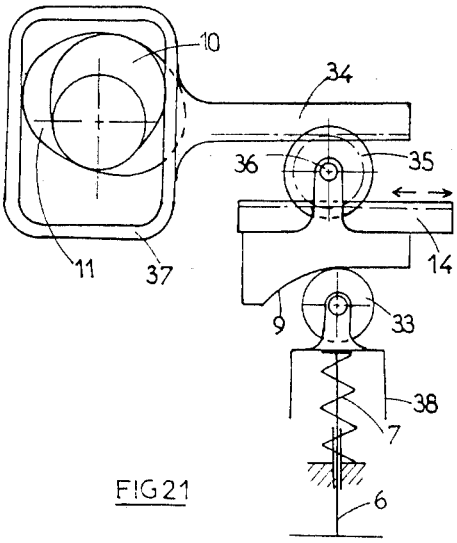

In the schematic representation of the fourth invention realization mode, FIG. 21, the movements of the satellite vehicle cam (9) and the rack (34) are reciprocal. The main cam (10) and the return cam (11) communicate primary reciprocal movement to the rack (34) by means of the frame (37). The reciprocal cam (9), whose unusable portion is straight, moves the valve (6) by means of the tappet (38). Adjustment is made by shifting the drive rack (14) which consequently shifts the satellite vehicle cam (9) by means of the satellite (35).

I claim:

1. Valve control mechanism for an internal combustion engine, for varying the lift of at least one valve of said engine, and comprising a kinematic chain including:

main cam means having one driving cam rotating around a first rotation axis which is a fixed axis, for producing an invariable alternating primary movement;

secondary cam means, consisting of a rocking cam to which said invariable alternating primary movement is transmitted so that said rocking cam produces a valve lift secondary movement for lifting said valve against the action of a return spring, with the help of at least one valve actuating member;

roller means interposed between and in contact with said valve actuating member and a profile of said rocking cam for transmitting to said valve actuating member said valve lift secondary movement that said roller means receives from said rocking cam; and, control means allowing to cause a relative displacement between said roller means and said rocking cam for making use of a portion of said rocking cam profile, wherein, said rocking cam is a cam oscillating around a second rotation axis and having at least one contact member in contact with said driving cam for transmitting said invariable alternating primary movement from said driving cam to said rocking cam, said roller means comprises a roller mounted on a roller axis and which contacts said rocking cam with said roller and said valve actuating member with said roller axis so that said roller receives said valve lift secondary movement from said rocking cam whereas said roller axis communicates said valve lift secondary movement to said valve actuating member; and, said control means includes support arms which are adjustably fastened about said second rotation axis and present guide grooves in which said roller axis is engaged and guided by its two ends, for changing the relative position between said roller and said rocking cam and thus the valve lift by changing the position of said support arms and thus of said roller around said second rotation axis.

2. Valve control mechanism as in claim 1, wherein said main cam means is in the form of a bilateral linkage consisting in said driving cam rocking said rocking cam in one direction around said second rotation axis, and in a return-cam rotating with said driving cam around said first rotation axis and rocking said rocking cam in the opposite direction around said second rotation axis through at least one contact member of said rocking cam with which said return cam is in contact.

3. Valve control mechanism as in claim 1, wherein said changing of the relative position between said roller and said rocking cam is obtained by positioning said guide grooves in a direction extending parallel to a neutral portion of said rocking cam profile.

4. Valve control mechanism as in claim 3, wherein said roller axis is in contact, while said valve is closing, with a portion of said valve actuating member having a part circular profile which is concentric with said neutral portion of said rocking cam profile.

5. Valve control mechanism as in claim 1, wherein said roller axis comprises, at each of its two ends, two parallel flat surfaces engaging the corresponding guide groove which is rectilinear and extends substantially radially with respect to said second rotation axis for laterally maintaining said roller axis with respect to said control means.

6. Valve control mechanism as in claim 1, wherein said valve actuating member has a U-shaped profile which laterally maintains said roller.

7. Valve control mechanism as in claim 1, wherein said valve actuating member is in contact with said roller axis along a zone of contact of the latter which has a radius of curvature greater than that of said roller axis outside of said zone of contact.

8. Valve control mechanism as in claim 1, wherein said roller axis is equipped with an anti-wear shoe having a central portion and two ends portions, said anti-wear shoe presenting, in its central portion, a clearance allowing said roller to pass so that said roller maintains said shoe in a lateral position, and said anti-wear shoe comprising at either of its end portions two bearing surfaces in the shape of arcs, one for engaging a corresponding groove formed in said roller axis for receiving the corresponding shoe end portion, and the other for engaging said valve actuating member so that during valve lift two rotations take place simultaneously around said bearing surfaces, one in said roller axis groove and the other on said valve actuating member.

* * * * *